United States Patent [19]

Janssen, Jr. et al.

[11] Patent Number: 4,603,454

[45] Date of Patent: Aug. 5, 1986

[54] HINGE FORMING AND ATTACHING APPARATUS

[76] Inventors: Alex P. Janssen, Jr., P. O. Box 43, Earlysville, Va. 22936; Alexander P. Janssen, 28 Old Farm Rd. Belair, Charlottesville, Va. 22901

[21] Appl. No.: 607,597

[22] Filed: May 7, 1984

Related U.S. Application Data

[63] Continuation of Ser. No. 430,246, Sep. 30, 1982, abandoned.

[51] Int. Cl.[4] ..... B21D 53/40; B21K 13/02; B23P 19/00

[52] U.S. Cl. ..... 29/11; 29/563; 29/564.6; 29/796; 72/404

[58] Field of Search ..... 29/11, 563, 564, 564.6, 29/565, 791, 795, 796; 72/404

[56] References Cited

U.S. PATENT DOCUMENTS

| | | | |
|---|---|---|---|
| 1,630,883 | 5/1927 | Aldeen . | |
| 1,654,362 | 12/1927 | Campbell | 29/11 X |
| 2,231,286 | 2/1941 | Firing | 153/1 |
| 2,252,202 | 8/1941 | Ralston et al. | 1/2 |
| 2,266,997 | 12/1941 | Sherman | 59/8 |
| 2,357,558 | 9/1944 | Sherman | 59/8 |
| 2,508,782 | 5/1953 | Carlile | 29/148 |
| 2,690,781 | 10/1954 | Hall | 153/1 |
| 3,472,549 | 10/1969 | Wiesmann | 29/11 |
| 4,010,524 | 3/1977 | Osamu et al. | 29/11 |

FOREIGN PATENT DOCUMENTS

| | | | |
|---|---|---|---|
| 259485 | 10/1925 | United Kingdom | 29/11 |
| 343008 | 2/1931 | United Kingdom | 29/11 |

*Primary Examiner*—Mark Rosenbaum
*Assistant Examiner*—Ronald S. Wallace
*Attorney, Agent, or Firm*—Lowe, Price, LeBlanc, Becker & Shur

[57] ABSTRACT

Apparatus for forming hinges from strip stock and for applying the hinges to cards and pockets. Hinge blanks including a pair of hinge legs are stamped from the strip stock and the barrel of the hinge partly formed at a first station. The blank then moves laterally to a second station where the legs are bent at a right angle to the hinge body and the barrel further shaped. Thereafter, the hinge continues in the same lateral path to a third station. Here, the formation of the barrel is completed; the hinge legs are driven through a pocket or card theretofore brought to the station; and the hinge legs are then bent over and against the pocket or card to secure the hinge to it.

12 Claims, 7 Drawing Figures

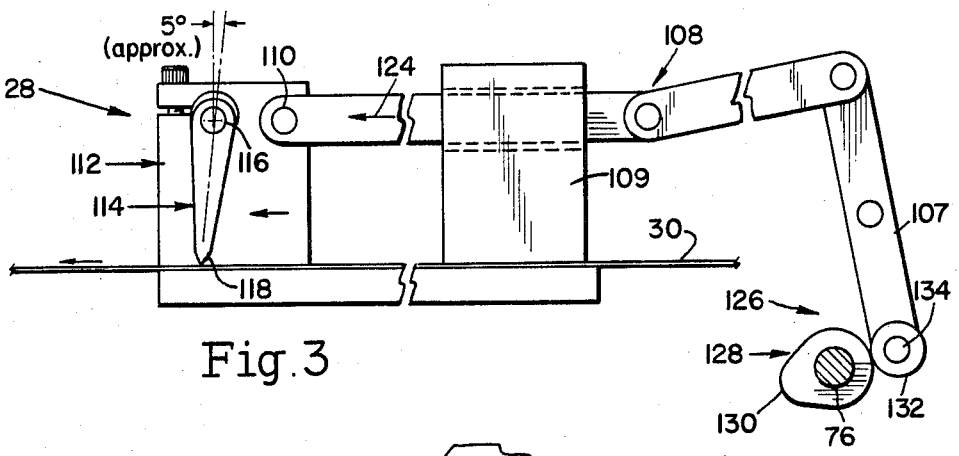
Fig.3
Fig.4
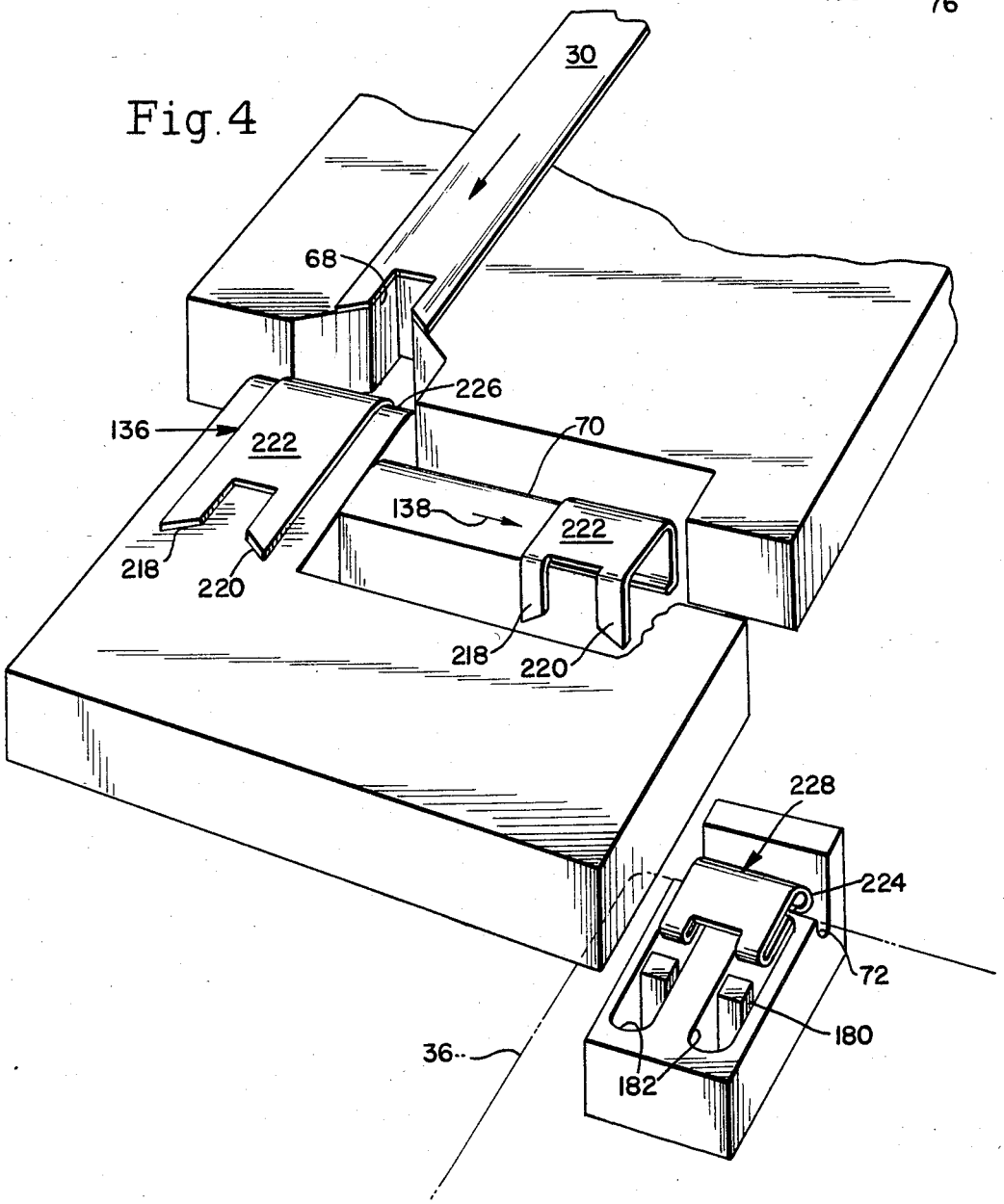

HINGE FORMING AND ATTACHING APPARATUS

This application is a continuation of application Ser. No. 430,246 filed Sept. 30, 1982, now abandoned.

The present invention relates to hinge forming and attaching apparatus and, more particularly, to novel, improved apparatus for forming hinges from strip stock and for clinching the hinges to articles of a sheet-, pocket-like, or similar character.

The principles of the present invention can be employed to particular advantage to make and attach hinges to pockets and cards of visible index systems. Those principles will accordingly be developed primarily by reference to those applications. It is to be understood, however, that this is being done primarily for the sake of clarity and convenience and is not intended to limit the scope of the invention as defined in the appended claims.

It is the primary object of the invention to provide apparatus with the capabilities described above.

The apparatus by which this and other important objects of the invention are met has a pair of hinge forming and attaching systems, each with a first station to which a strip of metallic material is fed in stepwise fashion.

At this station a hinge blank having spaced apart legs is struck from the strip. Concurrently, a hinge barrel is partially formed at that end of the blank opposite the hinge legs.

The blank is next shifted laterally to a second station where the legs are bent at a (typically) right angle to the body of the hinge and the forming of the barrel is continued. Finally, the hinge is shifted along the lateral path to a third station where the forming of the hinge barrel is completed. Also, at this station, the hinge legs are driven through the article to which the hinge is to be attached; and the legs are then bent over to fix the hinge in place.

A machine designed to perform the same overall tasks as our novel apparatus—form hinges from strip material and then attach them to visible index cards—is disclosed in U.S. Pat. No. 2,690,781 issued Oct. 5, 1954, to M. B. Hall. Our novel apparatus is in many ways superior to the Hall machine, however. For example, it is of simpler construction; and the repositioning of the dies and operating mechanisms necessary to accomodate index cards or other articles of different sizes can be more easily accomplished. Also, because the hinges are formed from individually fashioned blanks rather than severed from a strip, the formation of the hinges is not subject to the vagaries of a strip feed mechanism; and more uniformly dimensioned hinges are obtained. Furthermore, because the edges of the strips become the edges of those hinges produced by the apparatus disclosed herein, hinges with edges that are free of burrs and other imperfections can readily be produced.

The primary object of the invention has been identified above. Other important but more specific objects of the invention reside in the provision of hinge forming and attaching apparatus:

which is simple;

which is easy to set up;

which is capable of producing high quality, uniform hinges.

Other important objects and advantages and additional notable features of the present invention will become apparent from the appended claims and from the ensuing detailed description and discussion of the invention taken in conjunction with the accompanying drawing in which:

FIG. 3 is a side view of a mechanism employed to feed stock in strip form to the first of certain stations in the machine;

FIG. 4 is a partial pictorial view of the machine showing certain forming and cutting dies;

Figure 1:
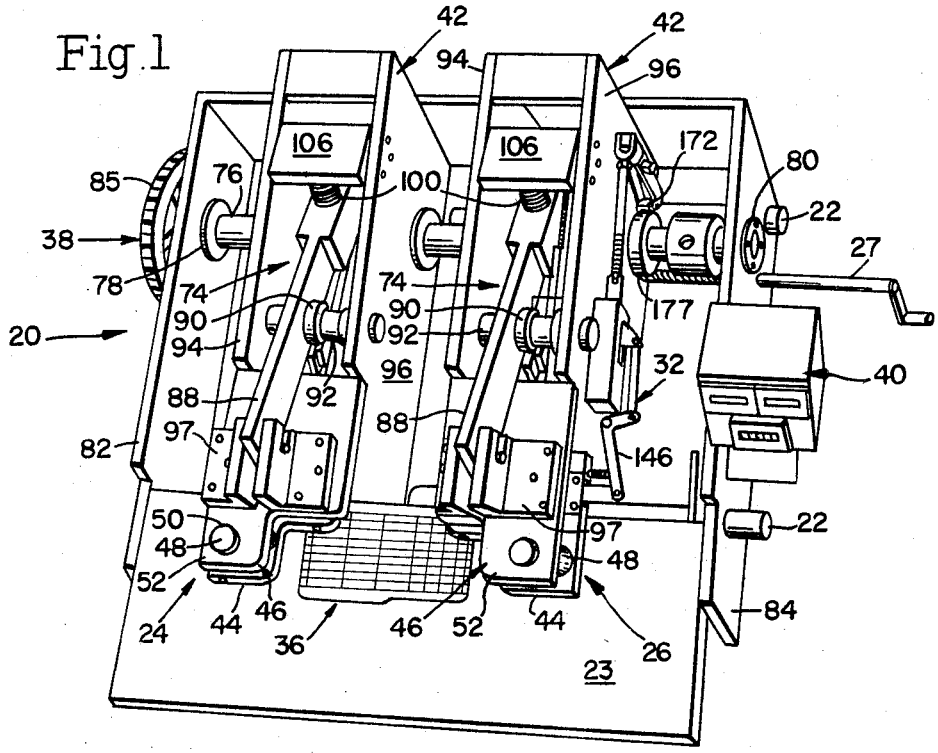
FIG. 1 is a perspective view of hinge forming and applying apparatus constructed in accord with the principles of the present invention.

Referring now to the drawing, FIG. 1 depicts a hinge forming and attaching machine 20 constructed in accord with, and embodying, the principles of the present invention. Machine 20 includes rails 22 supporting a removable work table 23 and two hinge forming and applying systems 24 and 26 which are in mirror image relationship; a crank mechanism 27 for displacing system 26 and thereby adjusting the spacing between it and system 24 to accommodate articles of different sizes; feedstock mechanisms 28 (one of which is shown in FIG. 3) for advancing strips 30 of feedstock to the hinge forming systems 24 and 26; a mechanism 32 for transferring partially formed hinges from the first to succeeding work stations for the two hinge forming systems 24 and 26; mechanisms 34 (see FIG. 7) for clinching the formed hinges to the artifact to which they are attached such as the visible index pocket card 36 shown in FIG. 1; a drive sytem 38 for operating the several mechanisms just identified; and a counter 40 for registering the number of cycles through which machine 20 is operated in any particular run.

Figure 5:
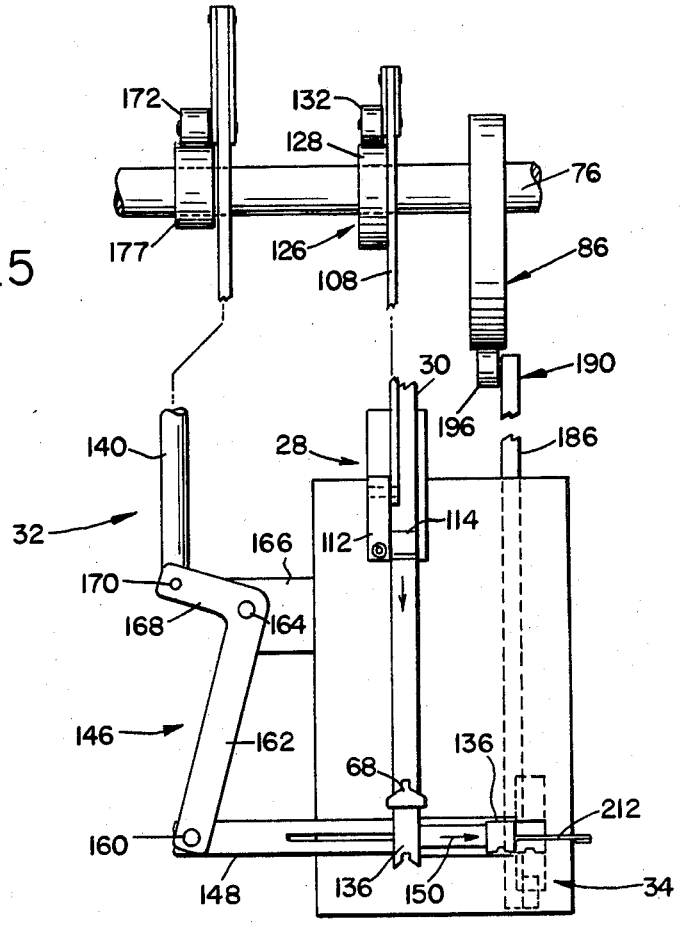
FIG. 5 is a partial plan view of the machine showing the mechanism for feeding the strip stock and for transferring partially formed hinges and the operating mechanism of a clincher employed to fix completed hinges to the artifact to which they are attached.
Figure 6:
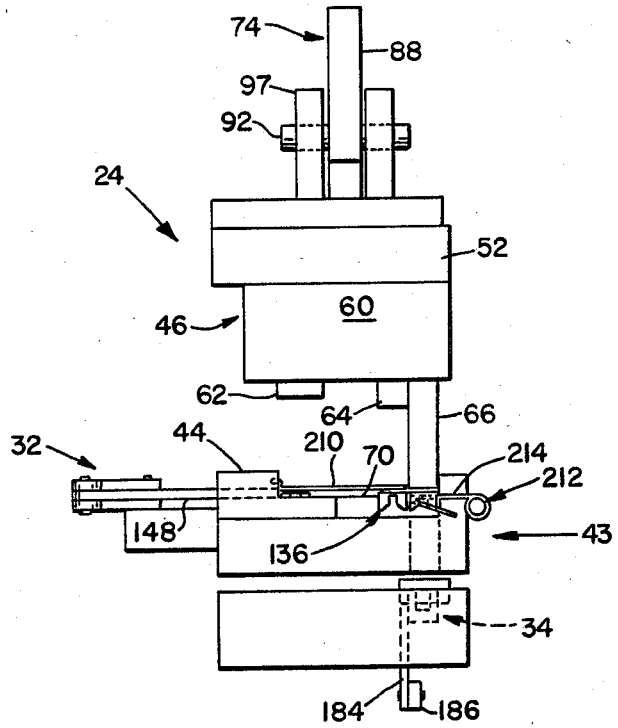
FIG. 6 is a partial front view of the machine showing one of two identical mechanisms employed to form and attach the completed hinges.
Figure 7:
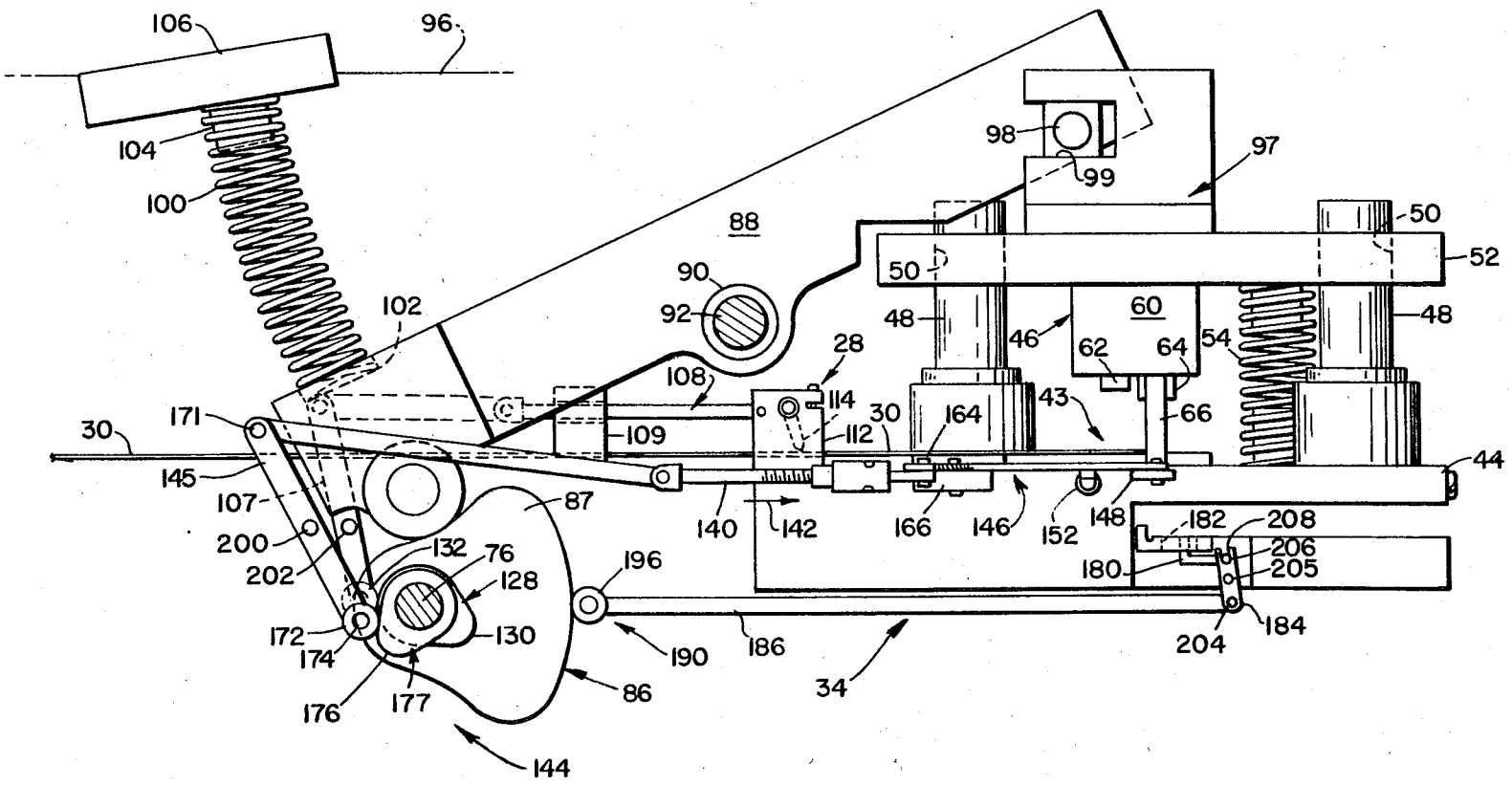
FIG. 7 is a partial side view of the machine showing the operating mechanism for the hinge forming mechanisms and the hinge clinching devices.

Referring now to FIGS. 1, 2, 4, 5, and 7, each of the two hinge forming and assembling mechanisms 24 and 26 includes a frame 42, typically formed from plate stock and supported by rails 22; a lower die set 43 which includes a shoe 44; and an upper die set 46 (see especially FIGS. 6 and 7). Die set 46 is supported above die set 43 for movement toward and away from the latter by vertical posts 48 extending upwardly through apertures 50 in a platen 52 which is a component of die set 46.

Die set 46 is biased to the upper, or inoperative, position shown in FIG. 7 by a spring 54 disposed between die shoe 44 and platen 52 respectively.

Referring now specifically to FIGS. 1, 6, and 7, die set 46 also includes a shoe 60 carrying punches or male dies 62, 64, and 66. Corresponding female dies and anvils 68, 70 and 72 are carried by die shoe 44.

Die set 46 and its male punch and dies 62, 64, and 66 are moved downwardly toward die shoe 44 by a lever-and-cam type operating machanism 74 which is supplied with motive power from the drive mechanism 38 identified earlier and shown in FIG. 1. The latter includes a transversely extending drive shaft 76 rotatably supported by bearings 78 and 80 from vertically extending supports 82 and 84 at opposite sides of machine 20. Shaft 76 is rotated by a belt drive including a motor (not shown) and a drive belt (likewise not shown) trained around a pulley 85 which is fixed to one end of shaft 76 for rotation therewith.

As is best shown in FIG. 7, each of the two die set operating mechanisms 74 associated with hinge forming and assembling systems 24 and 26 includes a cam 86 fixed to drive shaft 76 for rotation therewith. The lobe 87 of the cam is designed to engage one end of a rocker arm 88. The latter is pivotally supported by a bearing 90 on a shaft 92. This shaft is, in turn, supported from vertical members 94 and 96 (see FIG. 1) of frame 42 of the hinge forming and applying mechanism.

At the end of rocker arm 88 opposite cam 86 is a bracket 97 which is bolted or otherwise fixed to the platen 52 of die set 46. Rocker arm 88 is fixed to this bracket by a transversely extending pin 98 which extends through a slot 99 in the bracket. This allows the necessary freedom of movement between bracket 97 and rocker arm 88 as the latter is pivoted by cam 86 to move die set 46 down toward die shoe 44.

The final component of operating mechanism 74 is a return spring 100 for restoring die set 46 to the inactive position shown in FIG. 7 as the lobe 87 of cam 86 rides off rocker arm 88. At one end the return spring is installed in a seat 102 in the cam-engageable end of the rocker arm. The opposite, upper end of the spring surrounds a keeper 104 fixed to a spring support 106. This support is attached to the previously mentioned vertical supports 94 and 96 as is best shown in FIG. 1.

Referring now to FIGS. 2–5, the strip stock 30 which is formed into hinges in machine 20 is fed to each of the two hinge forming and assembling mechanisms 24 and 26 by a feed mechanism 28 of the character shown pictorially in FIG. 3.

This feed mechanism includes a pivotally mounted crank 107 and an articulated push rod 108 supported for rectilinear movement in a guide 109.

At its forward end, push rod 108 is fixed by a pin 110 to a feed member support 112. Support 112 carries an elongated feed member support 114 pivotally fixed to support member 112 by a pin 116. The lower end of feed member 114 terminates in a knife edge 118 which is engageable with the strip of stock 30.

The strip stock is typically supplied in a reel (not shown) and unwound from the latter onto machine 20 between guides 120 and 122.

Referring now most specifically to FIGS. 3 and 5, the push rod 108 of strip feeding mechanism 28 is rectilinearly advancable in the direction indicated by arrow 124 in FIG. 3 by a cam-and-follower mechanism 126. The latter includes a cam 128 fixed to drive shaft 76 for rotation therewith. The lobe 130 of the cam is designed to engage a follower 132 rotatably fixed to the rearmost end of push rod 108 by a pin 134.

As cam 128 moves the push rod in the direction indicated by arrow 124, the lower end 118 of finger 114 engages strip 30, moving it in incremental fashion and for a predetermined distance toward the associated hinge forming and assembling mechanism 24 or 26.

When the lobe 130 of the cam rides off follower 132, a return spring (not shown) restores the push rod 108 and feed member 114 to the inactive position shown in FIG. 3. As this occurs, feed member 114 is pivoted in a clockwise direction, releasing it from the strip 30 of feed stock.

One of the important features of the present invention is that the strip stock 30 fed from the rear toward the front of machine 20 in the manner just described is severed into independent hinge blanks (one of which is shown in FIG. 4 and identified by reference character 136) by punch 62 and die or anvil 68 with the hinge blanks then being shifted transversely or laterally in the direction indicated by arrow 138 in FIG. 4 to succeeding work stations where the hinges are further formed, assembled to an associated artifact, and clinched in place.

Figure 2:
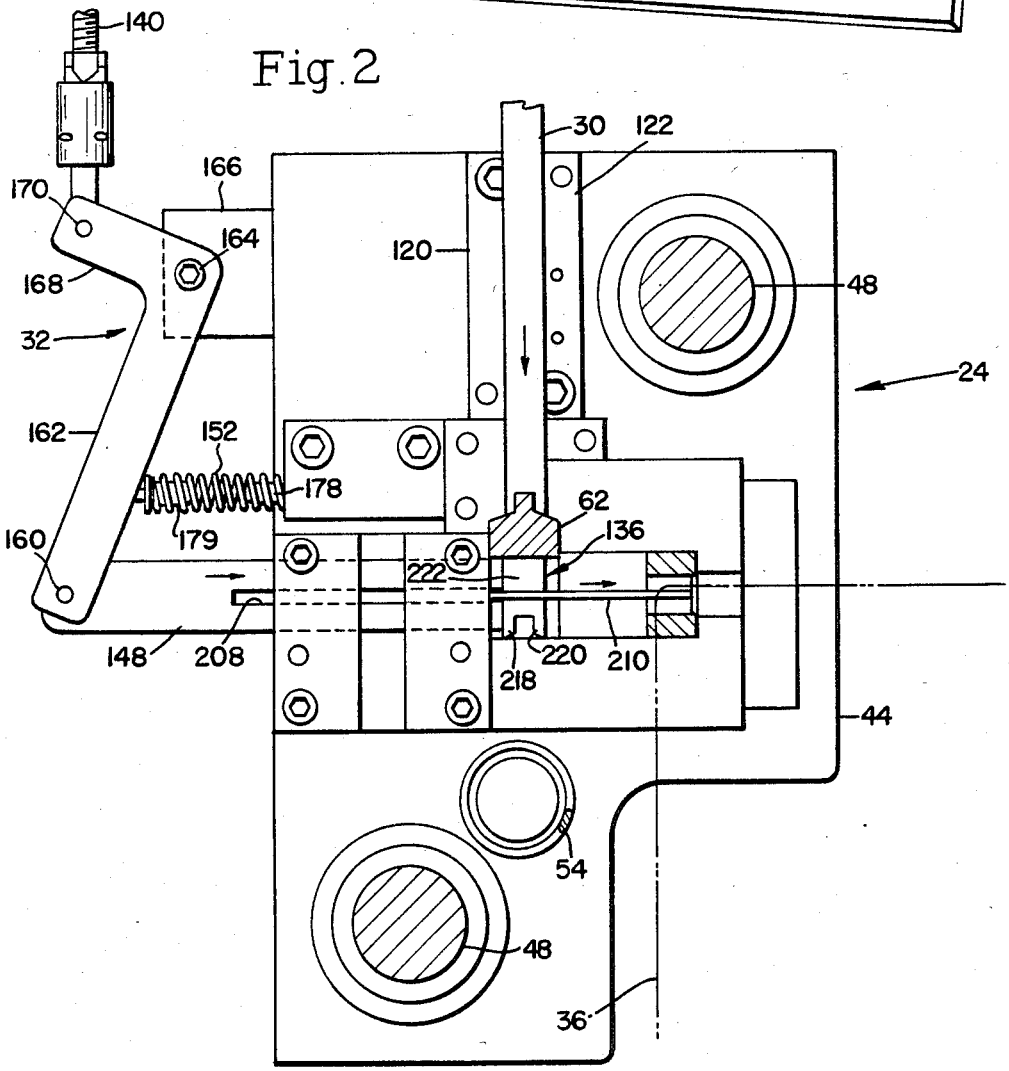
FIG. 2 is a plan view of a forming die included in the machine.

The transfer mechanism 32 mentioned briefly above and employed to shift the hinge blanks along the lateral path identified by reference character 138 is best shown in FIGS. 2 and 5. This mechanism includes an articulated push rod 140 which is displaceable along a rectilinear path identified by arrow 142 from the rear toward the front of machine 20 by a cam-and-follower mechanism 144 and a pivotally mounted crank 145; a bell crank 146 which is displaced in a counterclockwise direction by the foregoing movement of push rod 140; a transfer slide 148 which is displaced rectilinearly along the path identified by reference character 150 in FIG. 5 by the foregoing movement of the bell crank; and a return spring 152 (See FIG. 1) for restoring the transfer slide, crank, and push rod to the positions occupied by those components at the initiation of an operating cycle of machine 20.

Transfer slide 148 is pivotally fixed by a pin 160 to one forwardly extending arm 162 of bell crank 146. The latter is pivotally fixed by a pin 164 to a bell crank support 166. The second arm 168 of the crank is pivotally fixed by a pin 170 to the forward end of push rod 140.

At the opposite, rear end of push rod 140 that component is fixed to crank 145 by a pin 171. A cam follower 172 is rotatably fixed to the crank by a pin 174. This cam follower is engageable by the lobe 176 of a cam 177 which is fixed to drive shaft 76 for rotation therewith (see FIG. 7). The rotation of cam 177 by drive shaft 76 therefore effects the lateral, hinge blank shifting movement of transfer slide 148 along path 150 described above.

The return spring 152 is positioned by keepers 178 and 179 fixed to die shoe 44 and crank arm 162, respectively.

As discussed previously, at the final work station in each of the hinge forming and attaching systems 24 and 26 of machine 20: the theretofore formed legs of the hinge are driven through the artifact to which the hinges are to be attached (for example, the pocket card 36 shown in FIG. 1); and the legs of the hinge are then clinched against the artifact to secure the hinge in place. The previously mentioned mechanism 34 by which the hinges are clinched is shown in FIGS. 6 and 7 to which reference is now made. Mechanism 34 includes a clincher 180 mounted for rectilinear movement in a groove 182 fashioned in die shoe 44 and a crank 184, push rod 186, and cam-and-follower mechanism 190 for operating the clincher.

As is best illustrated in FIG. 7, cam-and-follower mechanism 190 includes the cam 86 fixed to drive shaft 76 for rotation therewith. The lobe 87 of the cam is engageable with a rotatable follower 196 fixed to the rear end of push rod 186 by pin 200. Consequently, the clockwise rotation imparted to cam 86 by the rotation of drive shaft 76 effects a counterclockwise motion of crank 184 and a movement of push rod 186 toward the front of machine 20.

At its forward end, the push rod which pivots about a pin 202 is connected to the lower end of crank 184 by a pin 204. Crank 184 pivots about a pin 205. Consequently, the forward motion of push rod 186 is translated into a counterclockwise rotation of crank 184. At its upper end, this crank is connected to clincher 180 by a pin-and-slot connection composed of a pin 206 extending transversely from the clincher and a slot 208 in the upper end of the crank. This translates the counterclockwise rotation of the crank into a rectilinear movement of clincher 180 towards the rear of machine 20 to clinch the legs of a hinge thereby engaged by the clincher.

Spring type retainers or holddowns 210 and 212 keep the blanks from which the hinges are formed in place after they are severed from the strip stock and shifted laterally to subsequent work stations from that first station where they are struck from the strips. Holddown 210, which is fashioned from spring wire, is fixed at one end to the hinge forming and assembling mechanism 24 or 26 with which the holddown is associated. As shown in FIG. 6, this holddown extends from the first station at which the hinge blanks are formed transversely of the hinge forming and assembling mechanism across the second station to which the blanks are thereafter laterally shifted. The leg 214 of holddown 212 likewise extends transversely to the second station as is shown in FIG. 7.

Next, the transfer mechanism 32 discussed above shifts the hinge blank 136 laterally along the path identified by arrow 138 to the second work station defined by the location of the male forming die 64 in die set 46. This die cooperates with the anvil 70 on die shoe 44 to carry out two simultaneous operations. The first is to bend the legs 218 and 220 of the hinge at right angles to the hinge body 222. At the same time, the formation of the hinge barrel is continued by bending the material of which it is formed at a right angle to the body 222 of the hinge on anvil 226 (see FIG. 4).

In the next operating cycle of machine 20, the displacement of the subsequent hinge blank 136 to the just described, second work station causes that blank 136 to engage the blank previously operated upon at that station. This transfers that blank, with its further formed hinge barrel and now depending hinge legs 218 and 220, along path 138 to the third, and final, work station where the third male die forces the blank into the female die 72 on die shoe 44 to complete the formation of hinge barrel 224. At the same time, the male die forces the legs 218 and 220 of the hinge 228 down through pocket card 36.

The foregoing forming operations, which are carried out simultaneously (albeit on three different blanks 136) are followed by a dwell. During the dwell, clincher mechanism 34 is actuated. As discussed above, clincher 180 thereupon moves toward the rear of machine 20. This folds hinge legs 218 and 220 up against the bottom side of the pocket card, securely fastening the hinge 228 to it to complete the operating cycle.

As indicated above, the two hinge forming and assembling mechanisms just discussed are mirror images of each other. Consequently, as will be apparent from FIG. 1, the hinge blanks are fed from the two mechanisms toward the center of the machine to attach them to the opposite, upper corners of pocket card 36.

It will be apparent to those skilled in the arts to which this disclosure is addressed that the successful operation of machine 20 required a careful sequencing of operations. This is carried out in a simple and elegant fashion in machine 20 simply by the respective angular positioning of the cams 86, 128, and 177 fixed to the drive shaft 76 of the machine.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What we claim and desire to have secured by Letters Patent of the United States is:

1. Apparatus for forming a hinge and for affixing it to an article, said apparatus comprising: means for feeding a strip of metallic material in a first rectilinear path to a first station; means at said first station for forming a hinge blank having a pair of spaced apart legs from said strip and for partially forming a hinge barrel at the opposite end of said blank from said legs; means for transfering said blank from said first station in a second rectilinear path oriented at right angles to said first path to a second station and then to a third station; means at said second station for bending said hinge legs generally normal to the hinge body and for effecting a further partial formation of the hinge barrel; and means at said third station for completing the formation of the hinge barrel, driving the hinge legs through an article as aforesaid theretofore located at said third station, and bending said hinge legs toward said article to clinch said hinge thereto.

2. Apparatus as defined in claim 1, wherein the means at said third station comprises a cooperating male die and an anvil for driving said hinge legs through said article, a separate hinge clinching means for bending said hinge legs toward said article, and means for effecting a dwell in the operation of said male die during the operation of said hinge clinching means, whereby said male die functions as an anvil durning the operation of said last-mentioned means.

3. Apparatus as defined in claim 2, together with means for biasing said hinge and said article against said male forming die during the operation of said hinge clinching means to thereby promote the proper functioning of said last-mentioned means.

4. Apparatus as defined in claim 1, wherein the means at said third station for bending the hinge legs toward said article to clinch the hinge thereto comprises a clincher and a cam-actuated operating mechanism for displacing said clincher also on a rectilinear path which is orthognally related to the bend lines of said hinge legs.

5. Apparatus as defined in claim 1, wherein the means for feeding said strip to said first station comprises a cam-actuated means for advancing said strip in steps of equal and preselected length along said first path, said strip feeding means having a pivotally mounted component for frictionally engaging and pushing said strip along said path.

6. Apparatus as defined in claim 1, wherein the means at said first station for forming said hinge blank and partially forming said hinge barrel, the means at said second station for bending said hinge legs and for effecting a further partial formation of the hinge barrel, and the means at said third station for completing the formation of the hinge barrel and for driving the hinge legs through the article are incorporated into a single die block.

7. Apparatus as defined in claim 6, together with means for effecting a rectilinear movement of said die block to carry out the aforesaid operations thereof which comprises a cam-actuated, die block-operating mechanism.

8. Apparatus as defined in claim 1, wherein the means for transferring the hinge blank along said rectilinear path from said first station to said second and third stations comprises a rectilinearly displacable transfer component, said apparatus also including means against which said blank can be formed and said last mentioned means providing a track along which said blank can be pushed.

9. Apparatus as defined in claim 8, which also includes means for displacing said transfer component which includes a cam-actuated crank for displacing said component in an operating direction and separate return means for restoring said component to an at rest position.

10. Apparatus as defined in claim 1, wherein the means at said third station for completing the formation of the hinge barrel and for driving the hinge legs through the article are incorporated into a male die means, wherein the apparatus also includes a cam-actuated means for operating the aforesaid male die means, and wherein the means at said third station for bending the hinge legs toward said article to clinch the hinge thereto comprises a cam-actuated, rectilinearly movable clincher, the cams of the cam-actuated means of said rectilinearly movable clincher and said male die means being fixed to a single shaft for rotation therewith and the cams being so angularly oriented relative to each other that said male die means is immobilized by its actuating mechanism to hold said hinge in place while the hinge legs are bent toward said article.

11. Apparatus as defined in claim 1, wherein the means for feeding said strip to said first station comprises a cam-actuated means for advancing said strip in steps of equal and preselected length along said first path; wherein the means at said first station for forming said blank and partially forming said hinge barrel, the means at said second station for bending said hinge legs and for effecting a further partial formation of the hinge barrel, and the means at said third station for completing the formation of the hinge barrel and for driving the hinge legs through the article comprise a single cam-actuated die means; wherein the means at said third station for bending the hinge legs toward said article to clinch the hinge thereto comprises a cam-actuated, rectilinearly movable clincher; wherein the means for transferring the hinge blank along said rectilinear path from said first station to said second and third stations comprises a rectilinearly dispacable, cam-actuated transfer mechanism; and wherein the apparatus also includes a single, rotatable drive shaft to which all of the cams of the aforesaid actuating means are fixed for rotation therewith.

12. Apparatus as defined in claim 1, which includes a support means along which said hinge blank can slide as it moves along said second rectilinear path and a resilient holddown means for biasing said member against said holddown means as it is moved along said path.

* * * * *